US010946507B1

(12) United States Patent
Wang

(10) Patent No.: US 10,946,507 B1
(45) Date of Patent: Mar. 16, 2021

(54) POWER TOOL

(71) Applicant: Master Air Tool Co., Ltd., Taichung (TW)

(72) Inventor: Nan-Hsin Wang, Taichung (TW)

(73) Assignee: MASTER AIR TOOL CO., LTD., Taichung (TW)

( * ) Notice: Subject to any disclaimer, the term of this patent is extended or adjusted under 35 U.S.C. 154(b) by 18 days.

(21) Appl. No.: 16/593,813

(22) Filed: Oct. 4, 2019

(51) Int. Cl.
*B25D 17/26* (2006.01)

(52) U.S. Cl.
CPC ..... *B25D 17/26* (2013.01)

(58) Field of Classification Search
CPC ..... B25D 17/26
USPC ..... 173/90, 197, 213, 171
See application file for complete search history.

(56) References Cited

U.S. PATENT DOCUMENTS 3,667,310 A * 6/1972 Hahner ..... B24B 23/028 74/417
3,719,254 A * 3/1973 Snider ..... F16H 57/0493 184/64
3,817,115 A * 6/1974 Schnizler ..... F16H 57/027 74/417
3,901,098 A * 8/1975 Jinkins ..... B23Q 5/045 74/417
4,135,411 A * 1/1979 Alessio ..... B24B 23/028 74/417
4,311,063 A * 1/1982 Sistare ..... B24B 23/028 74/395
4,696,199 A * 9/1987 Fabbri ..... F16H 1/14 74/417
5,052,496 A * 10/1991 Albert ..... B25F 3/00 173/29
5,251,406 A * 10/1993 Kirn ..... F16J 15/3284 451/344
6,125,721 A * 10/2000 Yang ..... B23Q 5/045 81/177.4
6,352,127 B1 * 3/2002 Yorde ..... B23Q 5/045 173/216
6,463,824 B1 * 10/2002 Prell ..... B23Q 5/045 173/29
7,077,736 B2 * 7/2006 Uzumcu ..... B23D 47/126 451/358
7,346,992 B2 * 3/2008 Hunger ..... B23D 47/126 30/276

(Continued)

FOREIGN PATENT DOCUMENTS

JP 2015058525 A * 3/2015 ..... B25F 5/00

*Primary Examiner* — Hemant Desai
*Assistant Examiner* — Jacob A Smith
(74) *Attorney, Agent, or Firm* — Sinorica, LLC

(57) ABSTRACT

A power tool includes a main body, a power input shaft unit having a driving bevel gear, and a power output shaft unit having a driven bevel gear to mesh with the driving bevel gear. The center of the power input shaft unit defines a first axis. The center of the power output shaft unit defines a second axis. The main body has an elbow portion corresponding in position to the intersection of the first axis and the second axis. An outer circumference of the elbow portion has a first plane parallel to the second axis and a second plane parallel to the first axis. The first plane is located between the second axis and the driving bevel gear. The second plane is located between the first axis and the driven bevel gear. The first plane and the second plane collectively define a recessed space.

4 Claims, 4 Drawing Sheets

(56) References Cited

U.S. PATENT DOCUMENTS

| | | | | |
|---|---|---|---|---|
| 7,722,444 | B2 * | 5/2010 | Gallagher | B25B 23/141 451/359 |
| 8,936,107 | B2 * | 1/2015 | Numata | B24B 47/12 173/216 |
| 9,826,989 | B2 * | 11/2017 | Chu | A61B 17/1684 |
| 2008/0017451 | A1 * | 1/2008 | Fukuoka | B63H 21/38 184/6.12 |
| 2008/0160888 | A1 * | 7/2008 | Hutchins | B24B 23/026 451/359 |
| 2009/0223691 | A1 * | 9/2009 | Ikuta | B25D 17/26 173/117 |
| 2011/0030983 | A1 * | 2/2011 | Kakiuchi | F16H 57/027 173/46 |
| 2013/0206442 | A1 * | 8/2013 | Wang | B24B 47/12 173/216 |

* cited by examiner

POWER TOOL

FIELD OF THE INVENTION

The present invention relates to a power tool, and more particularly to a power tool that can be operated in a narrow space while avoiding obstacles.

BACKGROUND OF THE INVENTION

U.S. Pat. No. 5,052,496 discloses a power tool. The power tool comprises a main body and a power input shaft that is transversely disposed inside the main body. One end of the main body is provided with an elbow portion. A power output shaft is longitudinally disposed inside the elbow portion. The power input shaft is provided with a driving bevel gear extending into the elbow portion. The upper end of the power output shaft is provided with a driven bevel gear that extends into the elbow portion and meshes with the driving bevel gear. When the power input shaft is driven by a power source, the driving bevel gear and the driven bevel gear mesh with each other to drive the power output shaft at a high speed, whereby the power tool can machine various articles.

The above patent discloses the internal structure and transmission of a general power tool. However, there are many problems in the use of the structure. The shortcomings of the conventional power tool are explained as follows:

(1) The power output shaft of the conventional power tool extends into the elbow portion. Two bearings are respectively disposed at the upper and lower sections of the elbow portion for supporting the power output shaft stably, so the elbow portion needs to have a sufficient internal space. As a result, the entire elbow portion is big in size. The power tool is easily hindered by the surrounding environment during operation and cannot enter a small space for work, so its use is limited greatly.

(2) In the conventional power tool, the power output shaft is in cooperation with two bearings. In addition to increasing the cost of parts, the assembly is also more troublesome. This is not beneficial for commercial competition.

(3) The conventional power tool uses the driving bevel gear and the driven bevel gear to mesh with each other for transmission, enabling the power output shaft to run at a high speed. Since the teeth of the driving and driven bevel gears are in frictional contact with each other, it is easy to generate a high temperature to affect the service life. It is required to fill the lubricating oil in time to facilitate the running of the driving and driven bevel gears. However, in the high-speed operation, the lubricating oil is exhausted quickly. Therefore, the user needs to replenish the lubricating oil frequently for the power tool, which causes great inconvenience in use.

Accordingly, the inventor of the present invention has devoted himself based on his many years of practical experiences to solve these problems.

SUMMARY OF THE INVENTION

The primary object of the present invention is to provide a power tool that has an elbow portion formed with a recessed space. The recessed space allows the power tool to enter a narrow space to machine more deeply, thereby achieving a convenient operation.

Another object of the present invention is to provide a power tool that has an elbow portion provided with a bearing therein for supporting a power output shaft, thereby saving parts and assembly cost.

A further object of the present invention is to provide a power tool that includes a driven bevel gear provided with an oil absorbing member and has a lubrication passage therein. When the driven bevel gear is rotated at a high speed, the oil absorbing member will release lubricating oil through the lubrication passage to lubricate the teeth, thereby achieving a long-term lubrication effect.

In order to achieve the above objects, a power tool comprises a main body, a power input shaft unit mounted at one end inside the main body, and a power output shaft unit mounted at another end inside the main body. A first axis is defined along a central position of the power input shaft unit. A second axis is defined along a central position of the power output shaft unit. The first axis and the second axis intersect each other at 90 degrees. The main body has an elbow portion corresponding in position to the intersection of the first axis and the second axis. The power input shaft unit includes a driving bevel gear extending into the elbow portion. The power output shaft unit includes a driven bevel gear disposed axially in the elbow portion. The driving bevel gear and the driven bevel gear mesh with each other. An outer circumference of the elbow portion has a first plane parallel to the second axis and a second plane parallel to the first axis. The first plane is located between the second axis and the driving bevel gear. The second plane is located between the first axis and the driven bevel gear. The first plane and the second plane collectively define a recessed space.

Preferably, the outer circumference of the elbow portion further has an angled guide surface connected between the first plane and the second plane.

Preferably, the power output shaft unit further includes a bearing fitted inside the elbow portion for supporting the output shaft.

Preferably, the power output shaft unit further includes an oil absorbing member. An outer circumference of the driven bevel gear is provided with a plurality of teeth to mesh with the driving bevel gear. A central portion of an end face of the driven bevel gear is formed with a circular accommodating seat to accommodate the oil absorbing member. The driven bevel gear has a lubrication passage therein. The lubrication passage extends from the position of the oil absorbing member to the position of the teeth.

Preferably, the circular accommodating seat is in the form of a truncated conical hole that is tapered upwardly. The oil absorbing member is made of a soft sponge material. The oil absorbing member is pressed and squeezed into the circular accommodating seat.

DETAILED DESCRIPTION OF THE PREFERRED EMBODIMENTS

Embodiments of the present invention will now be described, by way of example only, with reference to the accompanying drawings.

Figure 1:
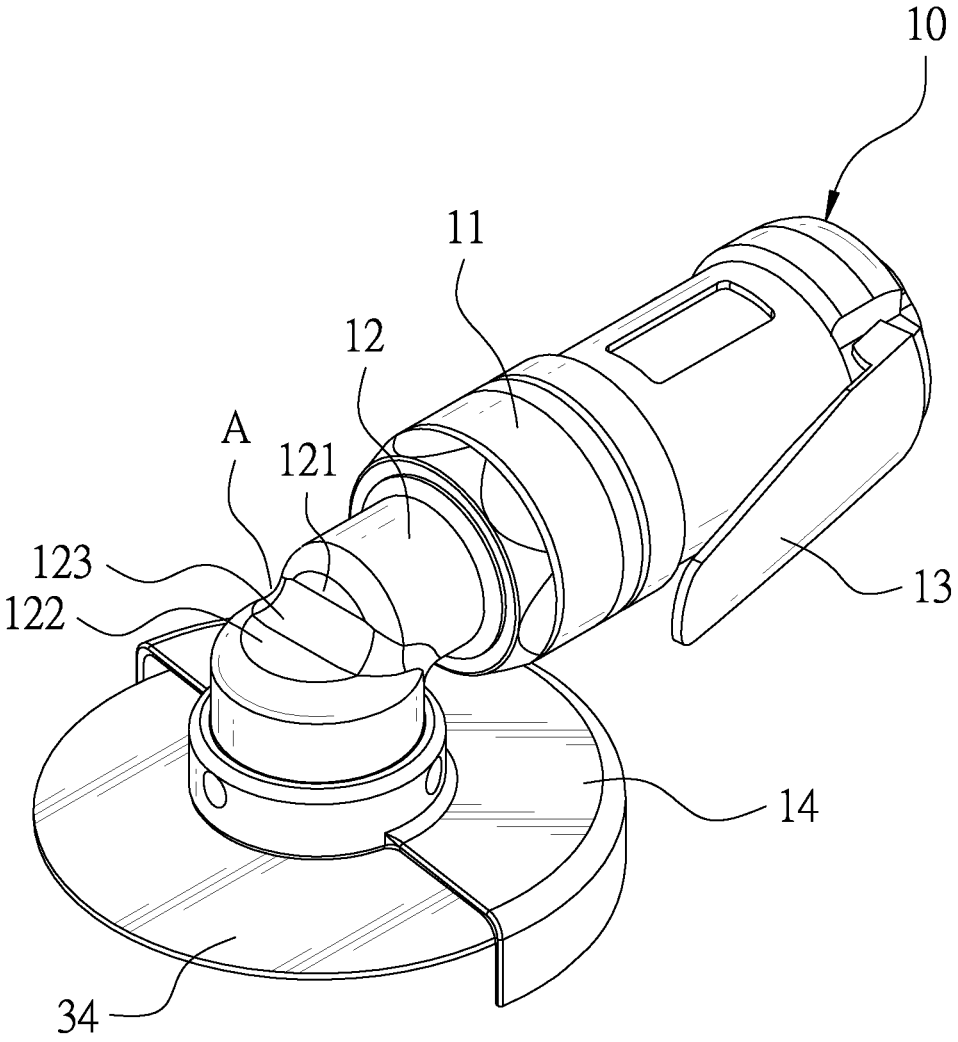
FIG. 1 is a perspective view according to a preferred embodiment of the present invention.
Figure 2:
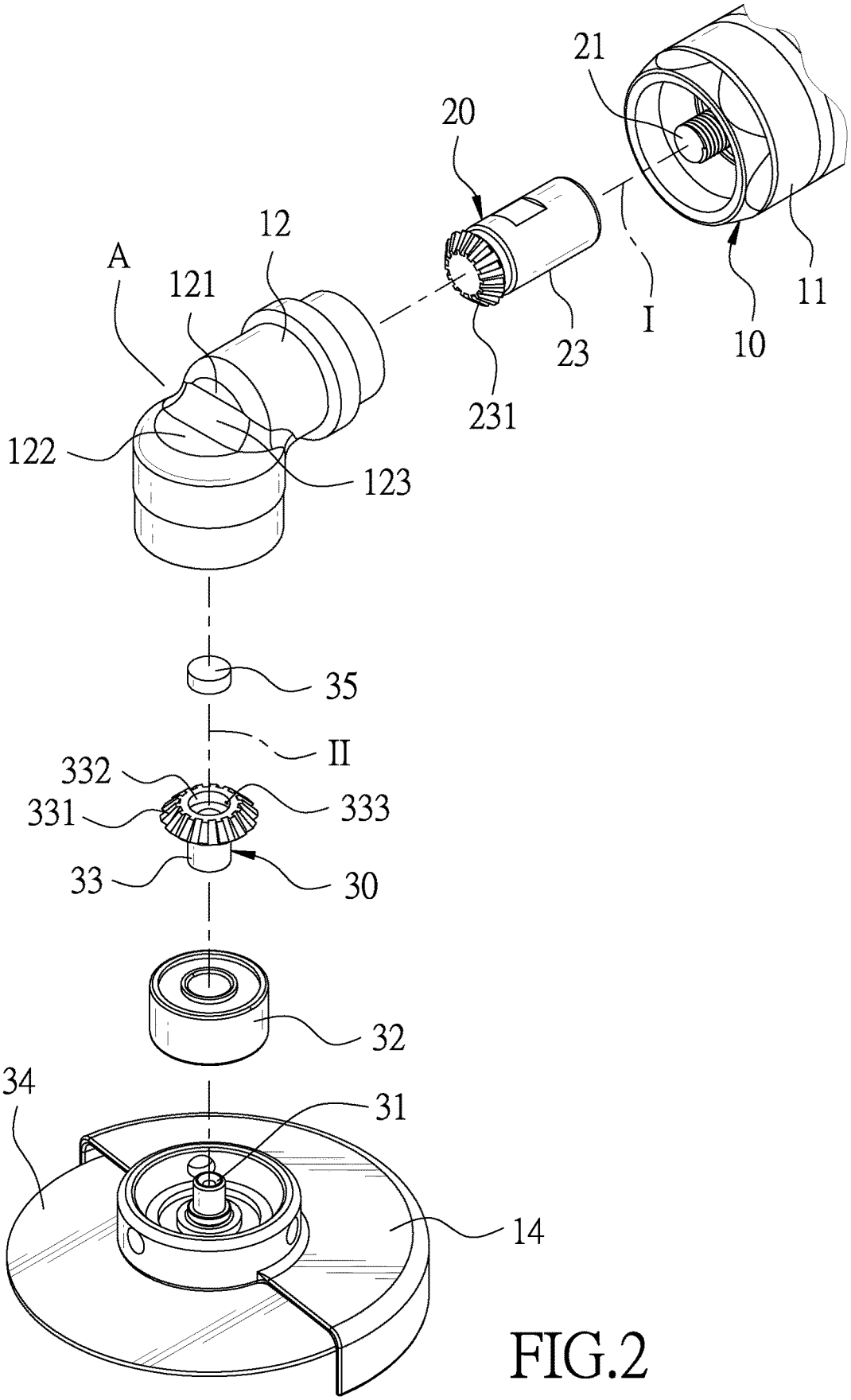
FIG. 2 is an exploded view according to the preferred embodiment of the present invention.
Figure 3:
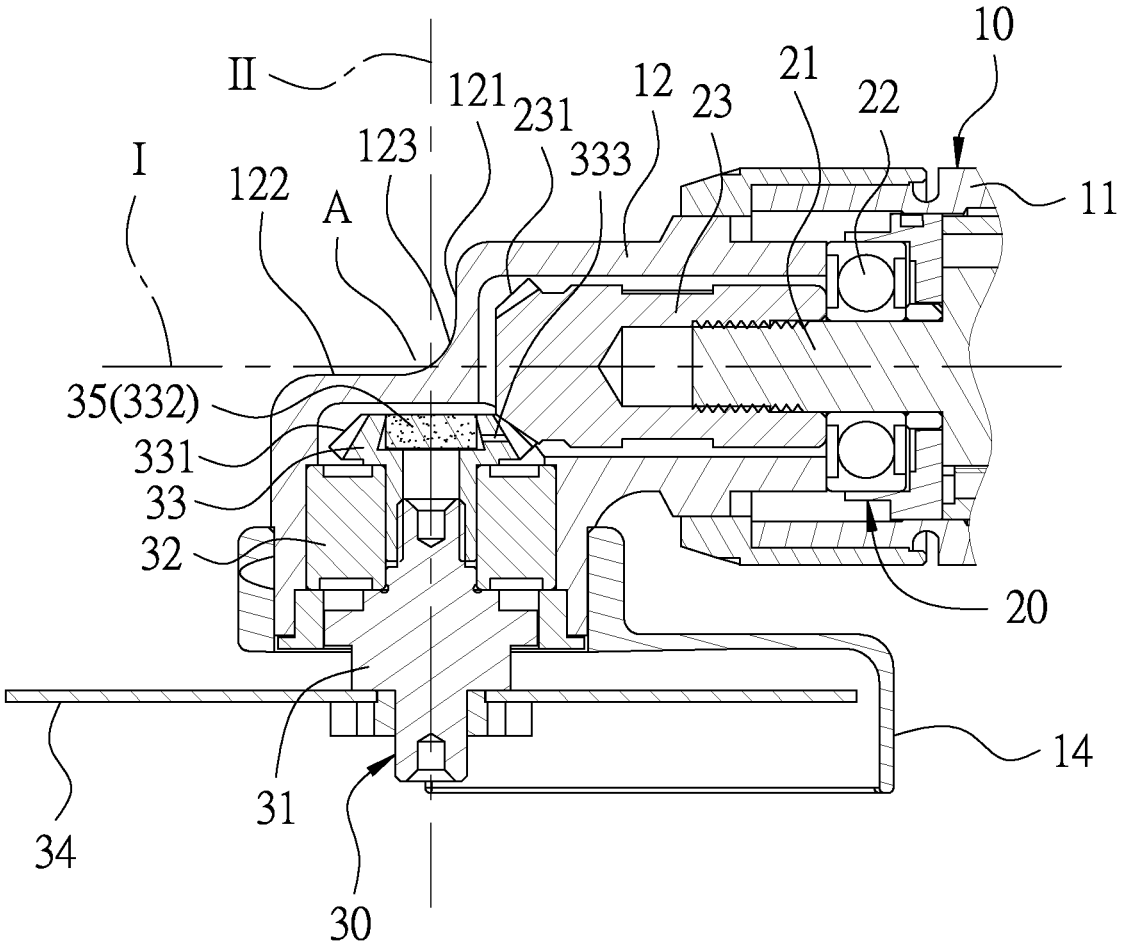
FIG. 3 is an assembled sectional view according to the preferred embodiment of the present invention, illustrating that the present invention comprises a main body, a power input shaft unit, and a power output shaft unit.

Referring to FIG. 1 through FIG. 3, a power tool according to a preferred embodiment of the present invention comprises a main body 10, a power input shaft unit 20 mounted at one end inside the main body 10, and a power output shaft unit 30 mounted at another end inside the main body 10. The main body 10 includes a housing 11 having a straight cylindrical shape, an elbow portion 12 mounted at the front end of the housing 11, a push switch 13 mounted at the rear end of the housing 11, and a semi-circular shell 14 disposed under the elbow portion 12. The power input shaft unit 20 includes an input shaft 21 disposed transversely in the housing 11, a bearing 22 fitted inside the housing 11 for the input shaft 21 to pass through, and a driving bevel gear 23 that is axially disposed at one end of the input shaft 21 and extends into the elbow portion 12. A first axis I is defined along a central position of the input shaft 21. The power output shaft unit 30 includes an output shaft 31 disposed longitudinally in the elbow portion 12, a bearing 32 disposed inside the elbow portion 12 for the output shaft 31 to pass through, a driven bevel gear 33 that is axially disposed at the upper end of the output shaft 31 and extends into the elbow portion 12, and a disc machining member 34 connected to the lower end of the output shaft 31. A second axis II is defined along a central position of the output shaft 31. The first axis I and the second axis II intersect each other at 90 degrees. The elbow portion 12 corresponds in position to the intersection of the first axis I and the second axis II. The outer circumference of the driving bevel gear 23 is provided with a plurality of teeth 231. The outer circumference of the driven bevel gear 33 is provided with a plurality of teeth 331. The teeth 231 of the driving bevel gear 23 and the teeth 331 of the driven bevel gear 33 mesh with each other for transmission.

The outer circumference of the elbow portion 12 has a first plane 121 parallel to the second axis II, a second plane 122 parallel to the first axis I, and an arcuate angled guide surface 123 connected between the first and second planes 121, 122. The first plane 121 is located between the second axis II and the driving bevel gear 23. The second plane 122 is located between the first axis I and the driven bevel gear 33. The first plane 121 and the second plane 122 collectively define a recessed space A at about 90 degrees.

The power output shaft unit 30 further includes an oil absorbing member 35. In this embodiment, the oil absorbing member 35 is made of a soft sponge material that can be impregnated with a large amount of lubricating oil for storage. Of course, the user may use other objects with oil absorption properties instead. A central portion of an end face of the driven bevel gear 33 is formed with a circular accommodating seat 332 to accommodate the oil absorbing member 35. The circular accommodating seat 332 is in the form of a truncated conical hole that is tapered upwardly. The oil absorbing member 35 is pressed and squeezed into the circular accommodating seat 332. The driven bevel gear 33 has a lubrication passage 333 therein. The lubrication passage 333 extends from the position of the oil absorbing member 35 to the position of the teeth 331.

The above is an overview of the main components and combination of the power tool of the present invention. Next, the use and the expected effects of the present invention are described below.

Figure 4:
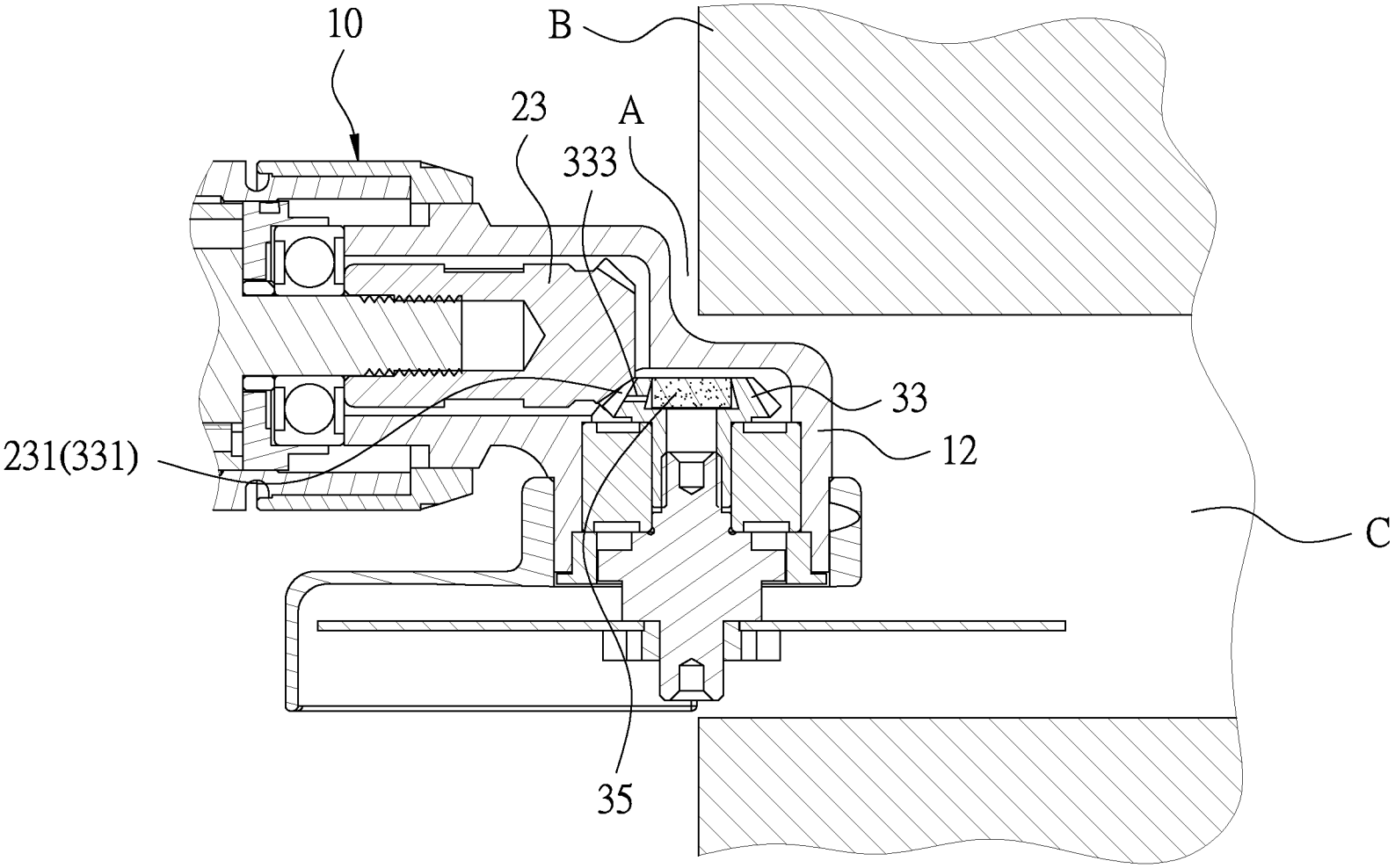
FIG. 4 is a schematic view showing the operation of the preferred embodiment of the present invention, illustrating that the main body has an elbow portion formed with a recessed space and that the recessed space allows the main body to avoid an obstruction and enter a narrow space.

Referring to FIG. 4, in use, if there is an obstruction B in the surrounding environment to hinder the min body 10 from entering the working area C, the main body 10 has the recessed space A of the elbow portion 12 to avoid the interference of the obstruction B, so that the main body 10 can enter the narrow working area C to perform machining. Further, when the driven bevel gear 33 is driven by the driving bevel gear 23 to rotate at a high speed, the oil absorbing member 35 slowly releases the lubricating oil impregnated in the oil absorbing member 35 due to the centrifugal force generated when the driven bevel gear 33 rotates. The lubricating oil flows through the lubrication passage 333 to the teeth 231, 331 of the driving and driven bevel gears 23, 33 for lubrication.

In summary, the power tool of the present invention solves the problems of the conventional power tool. The technical solution is that the outer circumference of the elbow portion 12 has the first plane 121 and the second plane 122. The first plane 121 and the second plane 122 collectively define the recessed space A at about 90 degrees. Thus, when the present invention is used in a narrow environment, if the main body 10 encounters an obstruction B, the main body 10 has the recessed space A to avoid the interference of the obstruction B, so that the main body 10 can enter the working area C to work more deeply. Thereby, the invention can be operated in a narrow space and has the effect of convenient operation. In addition, the power output shaft unit 30 of the present invention has the bearing 32 to support the output shaft 31 singly, which has few components, saves parts costs and shortens the assembly time. Finally, the present invention includes the oil absorbing member 35 disposed the driven bevel gear 33, and the oil absorbing member 35 can absorb lubricating oil for storage. When the driven bevel gear 33 is rotated at a high speed, the oil absorbing member 35 will release the lubricating oil outward by the centrifugal force. The lubricating oil flows through the lubrication passage 333 to the teeth 231, 331 of the driving and driven bevel gears 23, 33 for lubrication. Thereby, there is no need to fill the lubricating oil frequently, so the present invention has a long-term lubricating effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A power tool, comprising a main body, a power input shaft unit mounted at one end inside the main body, and a power output shaft unit mounted at another end inside the main body; a first axis being defined along a central position of the power input shaft unit, a second axis being defined along a central position of the power output shaft unit, the first axis and the second axis intersecting each other at 90 degrees, the main body having an elbow portion corresponding in position to the intersection of the first axis and the second axis, the power input shaft unit including a driving bevel gear extending into the elbow portion, the power output shaft unit including a driven bevel gear disposed axially in the elbow portion, the driving bevel gear and the driven bevel gear meshing with each other, characterized in that:

an outer circumference of the elbow portion has a first plane parallel to the second axis and a second plane parallel to the first axis, the first plane is located between the second axis and the driving bevel gear, the second plane is located between the first axis and the driven bevel gear, the first plane and the second plane collectively define a recessed space, and the power output shaft unit further includes an oil absorbing member, an outer circumference of the driven bevel gear is provided with a plurality of teeth to mesh with the driving bevel gear, a central portion of an end face of the driven bevel gear is formed with a circular accommodating seat to accommodate the oil absorbing member, the driven bevel gear has a lubrication passage therein, and the lubrication passage extends from the position of the oil absorbing member to the position of the teeth.

2. The power tool as claimed in claim 1, wherein the outer circumference of the elbow portion further has an angled guide surface connected between the first plane and the second plane.

3. The power tool as claimed in claim 1, wherein the power output shaft unit further includes a bearing fitted inside the elbow portion for supporting the output shaft.

4. The power tool as claimed in claim 1, wherein the circular accommodating seat is in the form of a truncated conical hole that is tapered upwardly, the oil absorbing member is made of a soft sponge material, and the oil absorbing member is pressed and squeezed into the circular accommodating seat.

* * * * *